US011149509B2

(12) United States Patent
Alouhali et al.

(10) Patent No.: US 11,149,509 B2
(45) Date of Patent: Oct. 19, 2021

(54) TROJAN DRILL PIPE

(71) Applicant: Saudi Arabian Oil Company, Dhahran (SA)

(72) Inventors: Raed Alouhali, Dhahran (SA); Timothy E. Moellendick, Dhahran (SA); Mohammed Badran, Dhahran (SA); Md Amanullah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 28 days.

(21) Appl. No.: 16/717,982

(22) Filed: Dec. 17, 2019

(65) Prior Publication Data

US 2021/0180422 A1 Jun. 17, 2021

(51) Int. Cl.
*E21B 27/02* (2006.01)

(52) U.S. Cl.
CPC ..... *E21B 27/02* (2013.01)

(58) Field of Classification Search
CPC combination set(s) only.
See application file for complete search history.

(56) References Cited

U.S. PATENT DOCUMENTS

| | | | |
|---|---|---|---|
| 3,786,878 A | 1/1974 | Sherman | |
| 4,064,941 A | 12/1977 | Smith | |
| 4,385,668 A | 5/1983 | Becker et al. | |
| 4,565,394 A | 1/1986 | Becker | |
| 5,582,251 A | 12/1996 | Bailey et al. | |
| 6,834,720 B1 | 12/2004 | Dwyer et al. | |
| 7,066,283 B2 | 6/2006 | Livingstone | |
| 7,090,023 B2 * | 8/2006 | Haugen | E21B 7/20 166/381 |
| 7,134,514 B2 | 11/2006 | Riel et al. | |
| 7,624,803 B2 | 11/2009 | Daccord et al. | |

(Continued)

FOREIGN PATENT DOCUMENTS

| | | |
|---|---|---|
| WO | 2004097155 A2 | 11/2004 |
| WO | 2020014206 A1 | 1/2020 |

OTHER PUBLICATIONS

International Search Report and Written Opinion of PCT Application No. PCT/US2020/065506 dated Mar. 1, 2021: pp. 1-12.

*Primary Examiner* — Taras P Bemko
*Assistant Examiner* — Ronald R Runyan
(74) *Attorney, Agent, or Firm* — Bracewell LLP; Constance G. Rhebergen; Linda L. Morgan

(57) ABSTRACT

A drill pipe assembly has an inner tubular member with a Trojan central bore. An outer tubular member circumscribes the inner tubular member. An annular storage space is defined between the outer tubular member and the inner tubular member. An uphole connection member connects to an uphole drill string so that the Trojan central bore is in communication with the uphole drill string. A downhole connection member connects to a downhole drill string so that the Trojan central bore is in communication with the downhole drill string. A window assembly is moveable between a closed position and an open position. In the open position the window assembly provides a flow path between the annular storage space and an outside of the outer tubular member. In the closed position the window assembly prevents a flow between the annular storage space and the outside of the outer tubular member.

17 Claims, 4 Drawing Sheets

(56) References Cited

U.S. PATENT DOCUMENTS

| | | | | |
|---|---|---|---|---|
| 8,136,594 | B2 * | 3/2012 | Streich | E21B 33/14 166/292 |
| 8,936,097 | B2 | 1/2015 | Heijnen et al. | |
| 9,790,767 | B2 | 10/2017 | Zhou | |
| 2019/0195035 | A1 * | 6/2019 | AlBahrani | E21B 21/003 |
| 2019/0323311 | A1 | 10/2019 | Al-Qasim et al. | |

* cited by examiner

TROJAN DRILL PIPE

BACKGROUND OF THE DISCLOSURE

1. Field of the Disclosure

The disclosure relates generally to hydrocarbon development operations in a subterranean well, and more particularly to delivering materials into a subterranean well during hydrocarbon development operations.

2. Description of the Related Art

During hydrocarbon development operations there may be times when it is desirable to have materials delivered into the wellbore as part of drilling or completion operations. As an example, and operator may wish to deliver a corrosive material, such as an acid, or a lubricant to avoid or remediate a stuck pipe. Alternately, a loss circulation material or other material that includes a significant amount of solids can be delivered to address a loss circulation zone. A component of cement may wish to be delivered separate from other components of the cementing or fluid circulation operations. Alternately, there may be other fluids and solids that are part of a two or more component composition that can be delivered downhole, such as for delaying the mixing of components to delay the activation or setting of the composition.

There may alternately be fluids and solids that can deteriorate or lose their effectiveness if combined with other wellbore fluids. Such fluids and solids can include, for example, various lubricants, cement additives, hole cleaning pills, or activators. During hydraulic fracturing applications, there may also be times when it is desirable for certain large diameter solids to be delivered downhole for use as a proppant.

SUMMARY OF THE DISCLOSURE

Embodiments of this disclosure provide systems and methods for delivering materials downhole within a wellbore without such materials being delivered through a bore of the drill pipe or through the annulus defined between the outer diameter of the drill pipe and the inner diameter surface of the wellbore. Systems and methods include concentric pipes that define an annular storage space between the concentric pipes for containing the materials. The materials are loaded into the storage space at the surface and can then be deployed in-situ on demand to assist with a particular development operation such as loss circulation, stuck pipe recovery, or hydraulic fracturing. Such concentric pipe system can be known as a Trojan drill pipe.

The inner pipe of the concentric pipes can have an inner diameter that is the same as the inner diameter of the traditional drill string joints be used so that the drilling operations can otherwise be unaffected by the use of the Trojan drill pipe. As an example, the transportation of drilling fluids from the surface to the drill bit can be unaffected by the use of the Trojan drill pipe. Window assemblies of the Trojan drill pipe can be activated from the surface to move to an open position so that the materials can be released into the annulus. The window assemblies can be moved to an open position at the specific depth within the wellbore directly where the material is needed. The window assemblies can have a sufficient surface area so that solids contained within the materials can be released into the annulus from the storage space.

In an embodiment of this disclosure a drill pipe assembly for drilling a subterranean well has an inner tubular member having a Trojan central bore centered around a central axis of the inner tubular member. An outer tubular member circumscribes the inner tubular member and is coaxially aligned with the inner tubular member. An annular storage space is defined by an inner diameter surface of the outer tubular member and an outer diameter surface of the inner tubular member. An uphole connection member is operable to connect to an uphole drill string so that the Trojan central bore is in communication with the uphole drill string. A downhole connection member is operable to connect to a downhole drill string so that the Trojan central bore is in communication with the downhole drill string. A window assembly is moveable between a closed position and an open position. In the open position the window assembly provides a flow path between the annular storage space and an outside of the outer tubular member. In the closed position the window assembly prevents a flow between the annular storage space and the outside of the outer tubular member.

In alternate embodiments, the annular storage space can be free of communication with the Trojan central bore. A material can be located within the annular storage space, where the material includes a solid material. The solid material can have a maximum dimension of 30 feet. The window assembly can have a window area that is more than 25% of a total surface area of an outer surface of the outer tubular member. Alternately, The window assembly can include a plurality of separate window elements and a cumulative window area which is a sum of an area of the plurality of separate window elements, can be more than 25% of a total surface area of an outer surface of the outer tubular member. Alternately, the window assembly can have a window area that is 50% of a total surface area of an outer surface of the outer tubular member.

In an alternate embodiment of this disclosure, a drill pipe assembly for drilling a subterranean well has an uphole drill string positioned within a wellbore of the subterranean well and has an uphole central bore. A downhole drill string is positioned within the wellbore of the subterranean well and has a downhole central bore. A Trojan drill pipe is positioned within the wellbore of the subterranean well between the uphole drill string and the downhole drill string. The Trojan drill pipe has an inner tubular member having a Trojan central bore centered around a central axis of the inner tubular member. The Trojan drill pipe also has an outer tubular member, the outer tubular member circumscribing the inner tubular member and being coaxially aligned with the inner tubular member. An annular storage space is defined by an inner diameter surface of the outer tubular member and an outer diameter surface of the inner tubular member. A window assembly is moveable between a closed position and an open position. In the open position the window assembly provides a flow path between the annular storage space and an annulus defined between an outer diameter surface of the outer tubular member and an inner diameter surface of the wellbore. In the closed position the window assembly prevents a flow between the annular storage space and the annulus. The uphole drill string is connected to an uphole end of the Trojan drill pipe so that the uphole central bore is in communication with the Trojan central bore. The downhole drill string is connected to a downhole end of the Trojan drill pipe so that the downhole central bore is in communication with the Trojan central bore. The uphole central bore has an uphole bore diameter, the Trojan central bore as a Trojan bore diameter, and the downhole central bore has a downhole bore diameter. The uphole bore diameter, the Trojan bore diameter, and the downhole bore diameter are substantially equal.

In alternate embodiments, the annular storage space can be free of communication with the Trojan central bore. A material can be located within the annular storage space, where the material includes a solid material. The solid material can have a maximum dimension of 30 feet. The window assembly can have a window area that is more than 25% of a total surface area of an outer surface of the outer tubular member. The window assembly can include a plurality of separate window elements and a cumulative window area which is a sum of an area of the plurality of separate window elements, can be more than 25% of a total surface area of an outer surface of the outer tubular member.

In another alternate embodiment of this disclosure, a method for drilling a subterranean well with a drill pipe assembly includes positioning a downhole drill string within a wellbore of the subterranean well, the downhole drill string having a downhole central bore. The downhole drill string is connected to a downhole end of a Trojan drill pipe and the Trojan drill pipe is positioned within the wellbore of the subterranean well. An uphole end of the Trojan drill pipe is connected to an uphole drill string having an uphole central bore, and the uphole drill string is positioned within the wellbore of the subterranean well so that the Trojan drill pipe is positioned within the wellbore of the subterranean well between the uphole drill string and the downhole drill string. The Trojan drill pipe has an inner tubular member having a Trojan central bore centered around a central axis of the inner tubular member. The Trojan central bore is in communication with the downhole central bore and the uphole central bore. An outer tubular member circumscribes the inner tubular member and is coaxially aligned with the inner tubular member. An annular storage space is defined by an inner diameter surface of the outer tubular member and an outer diameter surface of the inner tubular member. A window assembly is moveable between a closed position and an open position. The uphole central bore has an uphole bore diameter, the Trojan central bore as a Trojan bore diameter, and the downhole central bore has a downhole bore diameter, and the uphole bore diameter, the Trojan bore diameter, and the downhole bore diameter are substantially equal. The window assembly is moved from the closed position to the open position to deliver a material located within the annular storage space into an annulus defined between an outer diameter surface of the outer tubular member and an inner diameter surface of the wellbore. In the closed position the window assembly prevents a flow between the annular storage space and the annulus. In the open position the window assembly provides a flow path between the annular storage space and the annulus.

In alternate embodiments, the annular storage space can be free of communication with the Trojan central bore. The material can include a solid material and the method can further include delivering the solid material into the annulus. The solid material can have a maximum dimension of 30 feet. The window assembly can have a window area that is more than 25% of a total surface area of an outer surface of the outer tubular member. The window assembly can include a plurality of separate window elements and a cumulative window area which is a sum of an area of the plurality of separate window elements, can be more than 25% of a total surface area of an outer surface of the outer tubular member. Alternately, the window assembly can have a window area that is 50% of a total surface area of an outer surface of the outer tubular member.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE DISCLOSURE

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

As used in this specification, the term "substantially equal" means that the values being referenced have a difference of no more than two percent of the larger of the values being referenced.

Figure 1:
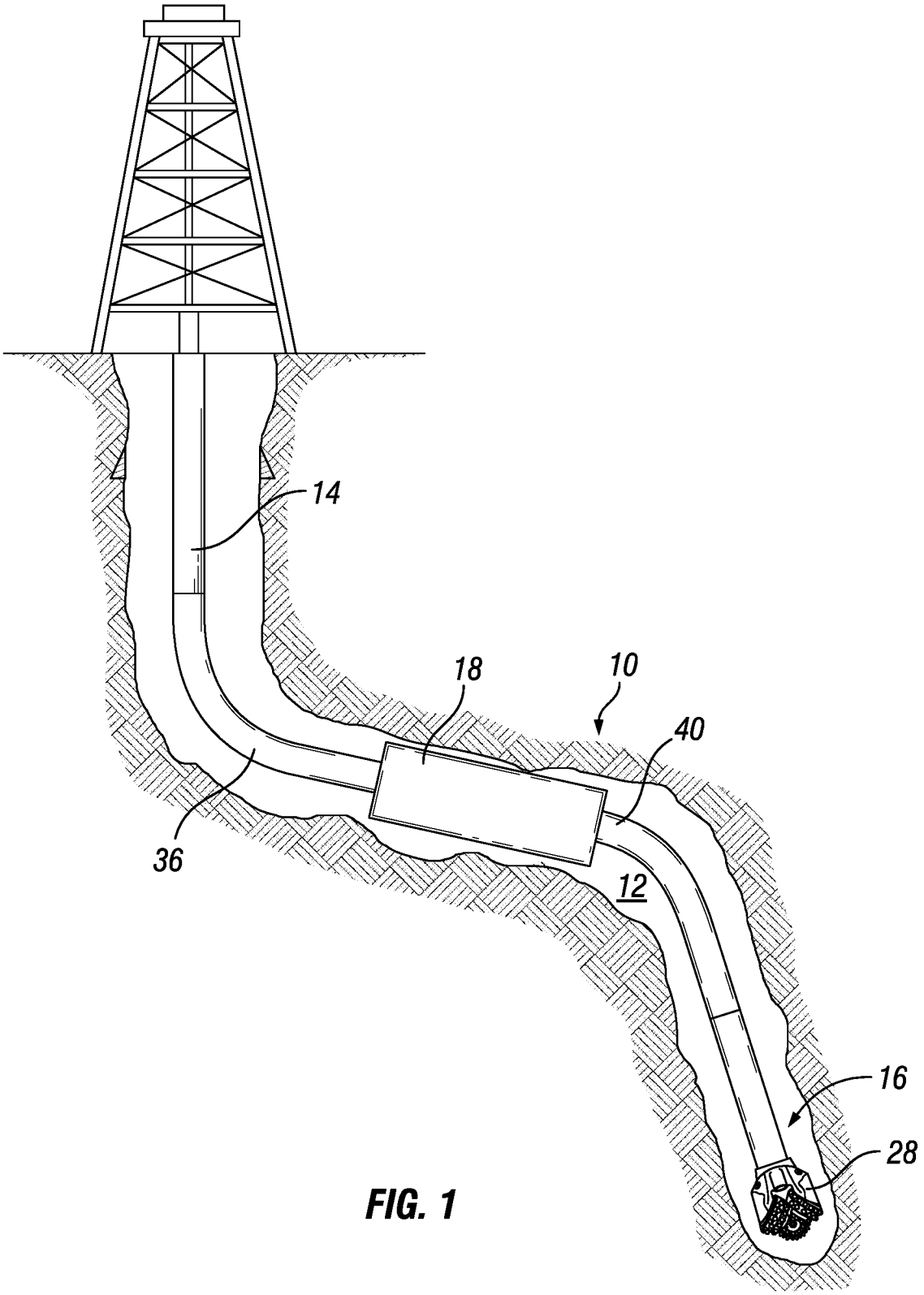
FIG. 1 is a schematic sectional representation of a subterranean well having a Trojan drill pipe, in accordance with an embodiment of this disclosure.

Looking at FIG. 1, subterranean well 10 extends downwards from a surface of the earth, which can be a ground level surface or a subsea surface. Wellbore 12 of subterranean well 10 can extended generally vertically relative to the surface. Wellbore 12 can alternately include portions that extend generally horizontally or in other directions that deviate from generally vertically from the surface. Subterranean well 10 can be a well associated with hydrocarbon development operations, such as a hydrocarbon production well, an injection well, or a water well.

Tubular string 14 extends into wellbore 12 of subterranean well 10. Tubular string 14 can be, for example, a drill string, a casing string, or another elongated member lowered into the subterranean well. In the example of FIG. 1, tubular string 14 is a drilling string with bottom hole assembly 16.

As tubular string 14 moves through wellbore 12, there may be times when an operator desires to deliver a material into wellbore 12. The material can be, for example, a liquid, a solid, or a combined liquid and solid. The material can be used, for example, for avoiding or remediating a stuck pipe, for delivery to a loss circulation zone, for cleaning wellbore 12, or for use in hydraulic fracturing operations. The material can be delivered into wellbore 12 from Trojan drill pipe 18.

Figure 2:
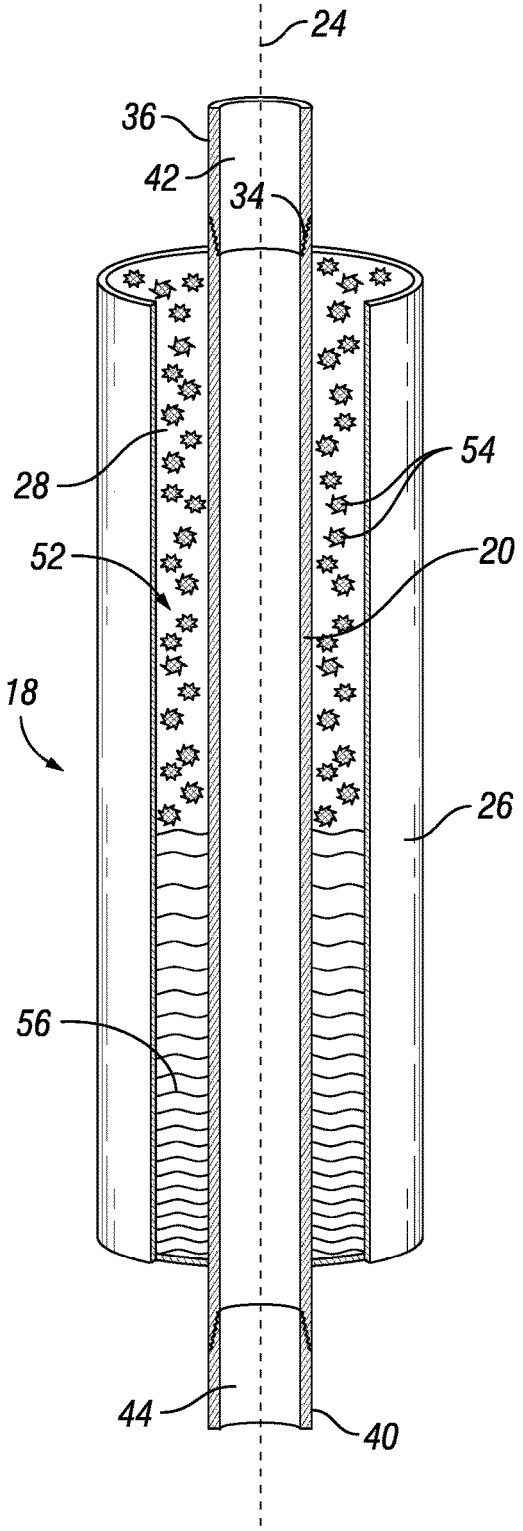
FIG. 2 is a section view of a Trojan drill pipe, in accordance with an embodiment of this disclosure.

Looking at FIG. 2, a drill pipe assembly for drilling subterranean well 10 can include Trojan drill pipe 18. Trojan drill pipe 18 can have inner tubular member 20. Inner tubular member 20 includes Trojan central bore 22 that is centered around central axis 24 of inner tubular member 20.

Trojan drill pipe 18 can further include outer tubular member 26. Outer tubular member 26 circumscribes inner tubular member 20 and is coaxially aligned with inner tubular member 20.

Annular storage space 28 is defined between an inner diameter surface of outer tubular member 26 and an outer diameter surface of inner tubular member 20. Annular storage space 28 can extend a full length of Trojan drill pipe 18. An uphole end of Trojan drill pipe 18 can have uphole end surface 30 (FIG. 3) that defines an uphole end of annular storage space 28. A downhole end of Trojan drill pipe 18 can have downhole end surface 32 (FIG. 3) that defines a downhole end of annular storage space 28.

Annular storage space 28 is free of communication with Trojan central bore 22. That is, there are no flow paths between annular storage space 28 and Trojan central bore 22. As an example, inner tubular member 20 can have a sidewall that is free of any penetrations.

Trojan drill pipe 18 includes uphole connection member 34 (FIG. 2) that is located at an uphole end of Trojan drill pipe 18. Uphole connection member 34 can secure Trojan drill pipe 18 to uphole drill string 36. In the example embodiment of FIG. 2, uphole connection member 34 is a threaded connector that can be commonly used in the industry to secure together joints of drill pipe. In alternate embodiments, uphole connection member 34 can include other commonly available connectors for securing together joints of a drill string.

Trojan drill pipe 18 also includes downhole connection member 38 (FIG. 4) that is located at a downhole end of Trojan drill pipe 18. Downhole connection member 38 can secure Trojan drill pipe 18 to downhole drill string 40. In the example embodiment of FIG. 4, downhole connection member 38 is a threaded connector that can be commonly used in the industry to secure together joints of drill pipe. In alternate embodiments, downhole connection member 38 can include other commonly available connectors for securing together joints of a drill string.

Figure 4:
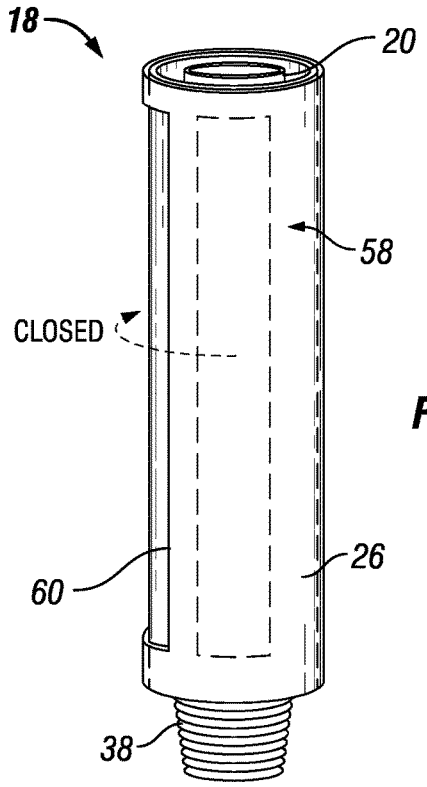
FIG. 4 is a perspective view of a Trojan drill pipe, in accordance with an embodiment of this disclosure, shown with vertical windows in a closed position.

Looking at FIGS. 2 and 4, uphole connection member 34 connects uphole drill string 36 to Trojan drill pipe 18 so that Trojan central bore 22 is in communication with uphole central bore 42 of uphole drill string 36. Downhole connection member 38 connects downhole drill string 40 to Trojan drill pipe 18 so that Trojan central bore 22 is in communication with downhole central bore 44 of downhole drill string 40. Therefore fluids, solids, or a combination of fluids and solids traveling through tubular string 14 can travel between uphole central bore 42 and downhole central bore 44 by way of Trojan central bore 22.

Figure 3:
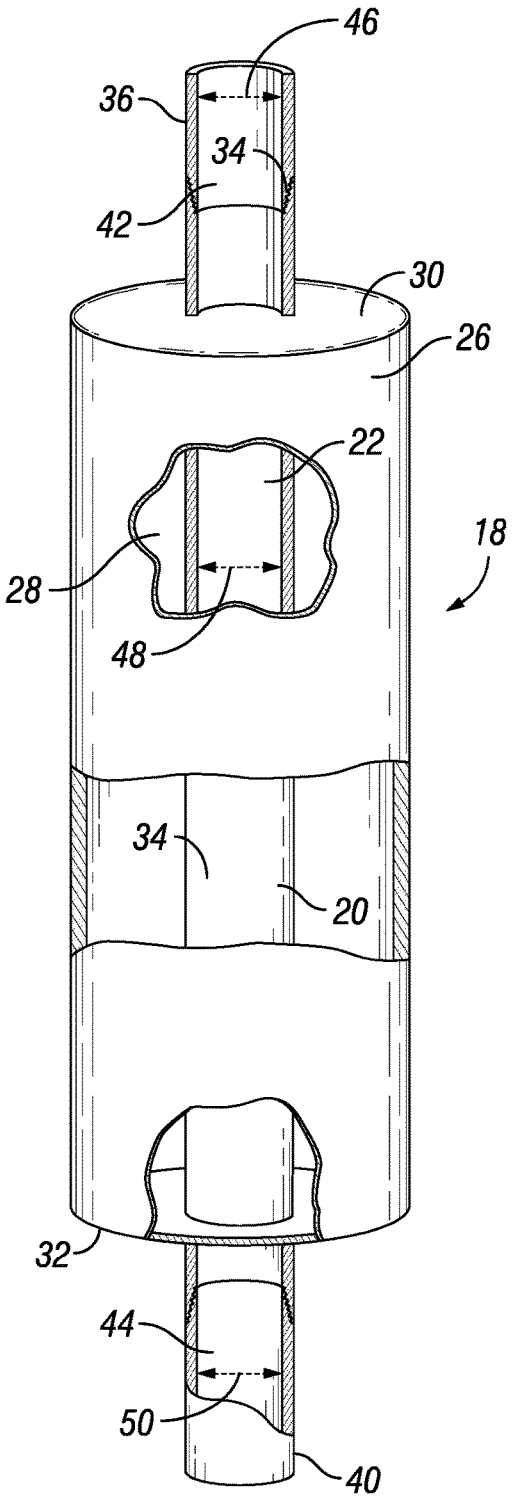
FIG. 3 is a perspective view of a Trojan drill pipe with certain sections shown, in accordance with an embodiment of this disclosure.

Looking at FIG. 3, uphole central bore 42 has uphole bore diameter 46, Trojan central bore 22 has Trojan bore diameter 48, and downhole central bore 44 has downhole bore diameter 50. Each of uphole bore diameter 46, Trojan bore diameter 48, and downhole bore diameter 50 is a measure of the inner diameter of the relevant tubular member. In embodiments, uphole drill string 36 and downhole drill string 40 are standard commercially available joints of drill string with the same specified inner diameter dimension so that uphole bore diameter 46 and downhole bore diameter 50 are substantially equal. In embodiments, Trojan bore diameter 48 is substantially equal to both uphole bore diameter 46 and downhole bore diameter 50. In this way, drilling or completion operations taking place through the bore of tubular string 14 can be unaffected by the use of Trojan drill pipe 18 as part of tubular string 14.

Looking at FIGS. 2-3, annular storage space 28 can contain material 52. The volume of material 52 that can be contained within annular storage space 28 of each Trojan drill pipe 18 is a function of the maximum allowable outer diameter of Trojan drill pipe and the smallest possible Trojan bore diameter 48 that could be accommodated for developing subterranean well 10. The volume of material 52 that can be contained within annular storage space 28 of each Trojan drill pipe 18 is also dependent on the wall thickness of inner tubular member 20 and outer tubular member 26.

Minimizing wall thickness of inner tubular member 20 and outer tubular member 26 will maximize the volume capacity of annular storage space 28 of each Trojan drill pipe 18. The wall thickness of inner tubular member 20 and outer tubular member 26 is limited by the required strength of inner tubular member 20 and outer tubular member 26. Inner tubular member 20 and outer tubular member 26 can be formed of high strength material to maximize strength and reduce wall thickness. As an example, inner tubular member 20 and outer tubular member 26 can be formed of conventional material such as steel or aluminum alloy, or alternately can be formed of advanced material such as non-metallic, composite, plastic, Nano-enhanced material or other material with suitable strength that is resistant to hydrogen sulfide.

The volume capacity of annular storage space 28 of each Trojan drill pipe 18 can also be maximized by forming Trojan drill pipe 18 with an outer tubular member 26 with the largest possible outer diameter and with an inner tubular member 20 with the smallest possible inner diameter. The largest possible outer diameter of outer tubular member 26 can be determined based on, for example, equivalent circulation density, the risk of a stuck pipe, and the design of the bottom hole assembly, combined with historical operational data gathered for each particular hole size. The smallest possible inner diameter of inner tubular member 20 can be dependent on the flow rate of fluids that is desired to be pumped through inner tubular member 20. The smaller the inner diameter of inner tubular member 20 the smaller the maximum possible flow rate through inner tubular member 20. Table 1 lists the volume capacity of annular storage space 28 of various sizes of Trojan drill pipe 18. Table 1 presents the volume capacity of annular storage space 28 of each Trojan drill pipe 18 as a function of the size of wellbore 12. The volume capacity of annular storage space 28 of each Trojan drill pipe 18 was calculated for a Trojan drill pipe 18 with a standard length of 90 feet.

TABLE 1

Volume Capacity of Annular Storage Space of the Trojan Drill Pipe

| Hole Size (in) | Largest OD (in) | Smallest ID (in) | DP Thickness (in) | Capacity (gallon/stand) |
|---|---|---|---|---|
| 22 | 19 | 1.185 | 0.28 | 78.05 |
| 16 | 14 | 1.185 | 0.28 | 54.68 |
| 12.25 | 9.5 | 1.185 | 0.28 | 33.64 |
| 8.5 | 6.75 | 1.185 | 0.28 | 20.78 |
| 6.125 | 4.75 | 1.185 | 0.28 | 11.43 |

Where: Hole Size is the inner diameter of wellbore 12; Largest OD is the outer diameter of outer tubular member 26; Smallest ID is the inner diameter of inner tubular member 20; DP Thickness is the sum of the sidewall thickness of both inner tubular member 20 and outer tubular member 26; and Capacity is provided per standard length Trojan drill pipe 18 of 90 feet.

Material 52 can include solids 54 and liquid 56. Solids 54 can include a solid material that has a length in a range of up to 30 feet. In alternate embodiments, solids 54 can have a maximum dimension of up to one third the size of a window assembly 58. In some current systems, material is delivered through the bore of the drill string and exits the drill string by way of nozzles, ports, or other openings through the drill bit or the drill string. Such openings can generally not accommodate solid material that is larger than one third the size of such nozzle or port. Solid material having a larger size can either be too large to fit through openings of current systems or would accumulate at the openings and eventually form a blockage of such openings.

Figure 5:
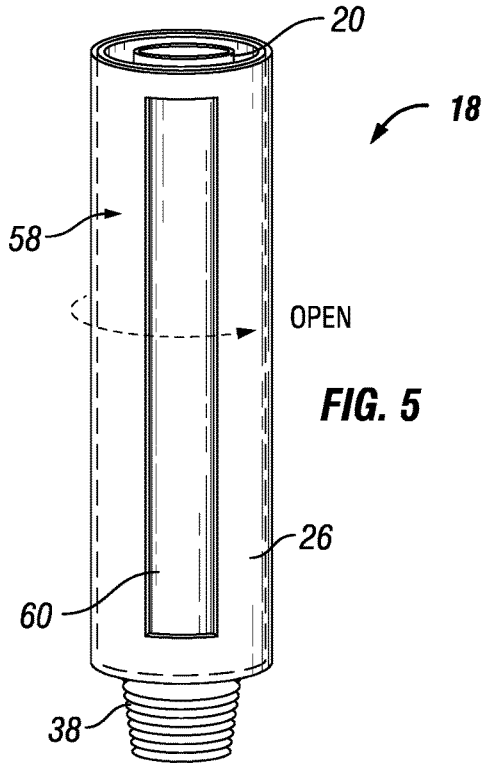
FIG. 5 is a perspective view of a Trojan drill pipe, in accordance with an embodiment of this disclosure, shown with vertical windows in an open position.
Figure 6:
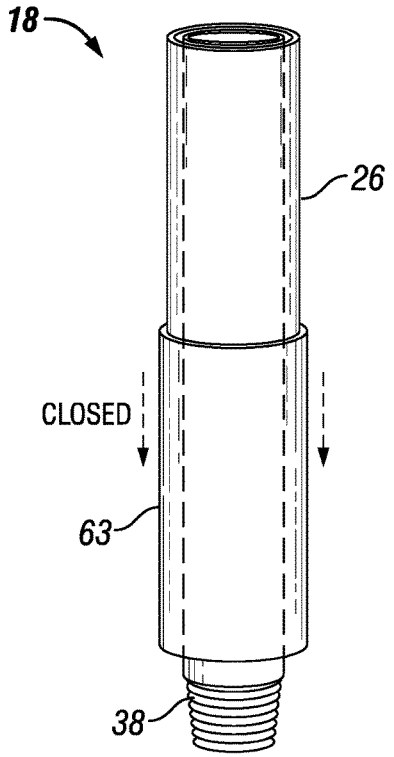
FIG. 6 is a perspective view of a Trojan drill pipe, in accordance with an embodiment of this disclosure, shown with a cylindrical windows in a closed position.
Figure 7:
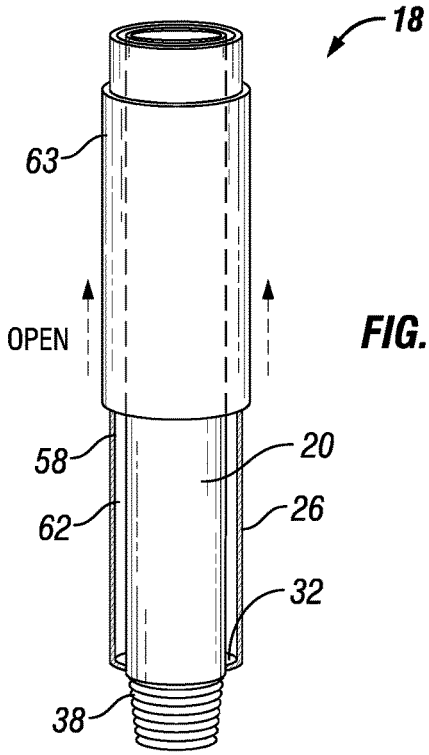
FIG. 7 is a perspective view of a Trojan drill pipe, in accordance with an embodiment of this disclosure, shown with a cylindrical windows in an open position.
Figure 8:
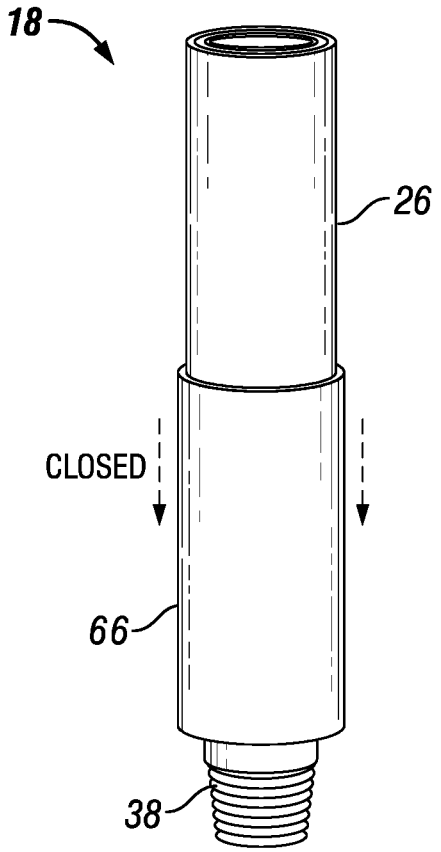
FIG. 8 is a perspective view of a Trojan drill pipe, in accordance with an embodiment of this disclosure, shown with a plurality of windows in a closed position.
Figure 9:
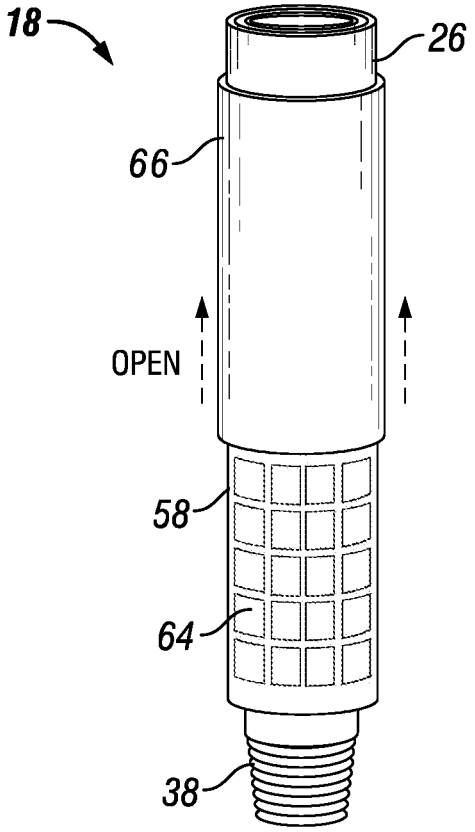
FIG. 9 is a perspective view of a Trojan drill pipe, in accordance with an embodiment of this disclosure, shown with a plurality of windows in an open position.

Looking at FIGS. 4-9, in order to provide for the delivery of material 52 into wellbore 12, Trojan drill pipe 18 can include window assembly 58. Window assembly 58 includes one or more openings through the sidewall of outer tubular member 26 and into annular storage space 28. Window assembly 58 is moveable between a closed position (FIGS. 4, 6, and 8) and an open position (FIGS. 5, 7, and 9).

In the closed position window assembly 58 prevents a flow of fluids, solids, or a combination of fluids and solids between annular storage space 28 and the outside of outer tubular member 26. When window assembly 58 is in the closed position, annular storage space 28 is a sealed chamber. When window assembly 58 is in the closed position, any fluids, solids of combination of fluids and solids within annular storage space 28 is prevented from reaching wellbore 12. In addition, when window assembly 58 is in the closed position, any fluids, solids of combination of fluids and solids within wellbore 12 is prevented from reaching annular storage space 28.

In the open position window assembly 58 provides a flow path between annular storage space 28 and the outside of outer tubular member 26. When window assembly 58 is in the open position, any fluids, solids of combination of fluids and solids within annular storage space 28 can travel from annular storage space 28 into wellbore 12. In addition, when window assembly 58 is in the open position, any fluids, solids of combination of fluids and solids within wellbore 12 can travel into annular storage space 28. The flow of fluids, solids, or a combination of fluids and solids traveling from wellbore 12 into annular storage space 28 can assist in moving the material 52 out of annular storage space 28 and into wellbore 12. Rotation of tubular string 14 can generate centrifugal forces on material 52 that can also assist in moving the material 52 out of annular storage space 28 and into wellbore 12.

Looking at FIGS. 4-5, window assembly 58 can include window elements that are axially oriented doors 60. Doors 60 are openings that extend through a sidewall of outer tubular member 26. In an example embodiment, there can be two doors 60 and each of the two doors 60 can have a surface area that is up to 25 percent (%) of the total surface area of the outer surface of outer tubular member 26. With two doors 60, when window assembly 58 is on the open position, up to 50% of the total surface area of the outer surface of outer tubular member 26 is open.

In the example of FIGS. 4-5, window assembly 58 includes an inner door that is static and an outer door that rotates circumferentially in relation to the inner door. The outer door moves circumferentially around an outer diameter of the tubular member that contains the inner doors to move between the closed position (FIG. 4) and the open position (FIG. 5). When window assembly 58 is in the open position, the outer door is aligned with the inner door. When window assembly 58 is in the closed position each door 60 is sealingly engaged with a solid portion of the outer tubular member that is not part of door or other opening so that annular storage space 28 is a sealed chamber.

In alternate examples, window assembly 58 can include one door 60 that has a surface area that is up to 50% of the total surface area of the outer surface of outer tubular member 26. Such an embodiment will allow for the deployment of relatively large solids 54, for example solids with a dimension of up to 30 feet. In such an embodiment when door 60 is in the open position up to 50% of the total surface area of the outer surface of outer tubular member 26 is open. In other alternate examples, window assembly 58 can include more than two doors 60. The cumulative surface area of all of the doors 60 can have a surface area that is up to 50% of the total surface area of the outer surface of outer tubular member 26. In other alternate embodiments, the arrangement of door 60 could provide a cumulative surface area that is more than 25% of the total surface area of the outer surface of outer tubular member 26. Having a surface area of window assembly 58 that is more than 25% of the total surface area of the outer surface of outer tubular member 26 will allow for the delivery of solids to be effectively delivered downhole with minimal risk of the solids becoming stuck within annular storage space 28.

Looking at FIGS. 6-7, window assembly 58 can include a window element that is a partial ring shaped band 62. In the example of FIGS. 6-7, there is one band 62. Band 62 can have a surface area that is up to 50% of the total surface area of the outer surface of outer tubular member 26. In such an embodiment when window assembly 58 is in the open position up to 50% of the total surface area of the outer surface of outer tubular member 26 is open. In the example of FIGS. 6-7, band cover 63 moves axially in an uphole direction around an outer diameter of outer tubular member 26 to move window assembly 58 between the closed position (FIG. 6) and the open position (FIG. 7). When window assembly 58 is in the open position, band cover 63 overlaps a portion of the outer diameter of outer tubular member 26 that is not part of a window. When window assembly 58 is in the closed position band 62 is sealingly engaged with a static portion of the outer tubular member over band 62 so that annular storage space 28 is a sealed chamber.

In alternate examples, window assembly 58 can include more than one band 62 or more than one band cover 63, or both more than one band 62 and more than one band cover 63. Multiple band covers 63 can nest over a portion of the outer diameter of outer tubular member 26 that is not part of a window so that the portion of the surface area of outer tubular member 26 that is open after each of the multiple band covers 63 have been moved to the open position the opening through outer tubular member 26 is 50% of the total surface area of the outer surface of outer tubular member 26. In other alternate examples where the band covers 63 are nested in the open position, the cumulative surface area of the openings through outer tubular member 26 can be more than 50% of the total surface area of the outer surface of outer tubular member 26. In yet other alternate examples, the cumulative surface area of the openings through outer tubular member 26 can be at least 25% of the total surface area of the outer surface of outer tubular member 26.

Looking at FIGS. 8-9, window assembly 58 can include a plurality of individual openings 64 through outer tubular member 26 and a sliding sleeve 66. In the example of FIGS. 8-9, there are rows and columns of individual openings 64 that are spaced around the outer surface of outer tubular member 26. Sliding sleeve 66 can circumscribe outer tubular member 26. In the example of FIGS. 8-9, sliding sleeve 66 can move axially uphole when moving from the closed position (FIG. 8) to the open position (FIG. 9).

When window assembly 58 is in the open position, sliding sleeve 66 overlaps a portion of the outer diameter of outer tubular member 26 that is not part of a window. When window assembly 58 is in the closed position sliding sleeve 66 sealingly engaged with a static portion of the outer tubular member over all of the individual openings 64 so that annular storage space 28 is a sealed chamber.

The cumulative surface area of all of the individual openings 64 can be a surface area that is up to 50% of the total surface area of the outer surface of outer tubular member 26. In such an embodiment when window assembly 58 is in the open position up to 50% of the total surface area of the outer surface of outer tubular member 26 is open. In other alternate embodiments, the arrangement of individual openings 64 could provide a cumulative surface area that is more than 25% of the total surface area of the outer surface of outer tubular member 26.

An actuation device can be used to move window assembly 58 between the closed position and the open position. The actuation device can be signaled from the surface by known methods, such as by radio-frequency identification, a drop ball, or a signal provided through a wired or wireless transmission.

In an example of operation, drilling subterranean well 10 with drill pipe assembly includes positioning downhole drill string 40 within wellbore 12 of subterranean well 10. Downhole drill string 40 is connected to a downhole end of Trojan drill pipe 18 and an uphole end of Trojan drill pipe 18 is connected to uphole drill string 36. Trojan drill pipe 18 is connected to downhole drill string 40 and uphole drill string 36 such that Trojan central bore 22 is in communication with downhole central bore 44 and uphole central bore 42.

Annular storage space 28 can be loaded with material 52 prior to delivering Trojan drill pipe 18 into subterranean well 10. Material 52 can contain a liquid, a solid, or a combination of liquid and solid. Material 52 can be selected to perform a predetermined function within subterranean well 10, such as avoiding or remediating a stuck pipe, cleaning wellbore 12, delivering a lubricant, delivering a component of a cement composition, addressing a loss circulation problem, or providing a component of a hydraulic fracturing operation.

When Trojan drill pipe 18 reaches the desired depth where the predetermined function is to be performed, window assembly 58 can be moved from a closed position to an open position to release material 52 from annular storage space 28 and deliver material 52 into wellbore 12. The release of material 52 can be assisted by rotation of tubular string 14 or by the mixing of fluids within wellbore 12 with material 52 within annular storage space 28.

Embodiments of this disclosure can therefore can provide liquids and solids to a downhole location without the need to pass such liquids and solids through pumps, flow lines, or the drill pipe, reducing the risk of damage to such pumps, flow lines, or the drill pipe. Embodiments of this disclosure would therefore be particularly useful where such liquids and solids could be harsh chemicals or result in a buildup of solid material that could plug the pumps, flow lines, or the drill pipe. Systems and method of this disclosure can also provide for deployment of two-component solutions without the risk of premature activation within the drill pipe, or the risk of contaminating one of the components with other fluids or solids that exist within the wellbore or the drill pipe.

Some current solutions for delivering solid material downhole include making two trips to the surface with the drill pipe. A first trip is required to remove the drill bit so that the solid material can exit an open end of the drill string. A second trip is required to reattach the drill bit. Embodiment of this disclosure only require a single trip to the surface to load the solid material in the Trojan drill pipe and make up the Trojan drill pipe with the drill string.

Embodiments of this disclosure can further broaden the spectrum of possible intervention methods and items to be deployed downhole. The size and pumpability of the intervention material will be increased compared to currently available systems. As an example, loading a 30 feet screen that is used to combat sever loss circulation will be possible with embodiments of the Trojan drill pipe of this disclosure.

In addition, the use of the Trojan drill pipe will allow for an exact volume of liquids and solids to be delivered to the wellbore. In some current methods the volume of liquids and solids required to ensure a sufficient amount reaches the desired location would be larger because of the uncertainty involved in delivering fluids and solids to a downhole location from the surface.

Embodiments of the disclosure described, therefore, are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A drill pipe assembly for drilling a subterranean well, the assembly having:

an inner tubular member having a Trojan central bore centered around a central axis of the inner tubular member;

an outer tubular member, the outer tubular member circumscribing the inner tubular member and being coaxially aligned with the inner tubular member;

an annular storage space defined by an inner diameter surface of the outer tubular member and an outer diameter surface of the inner tubular member;

an uphole connection member operable to connect to an uphole drill string so that the Trojan central bore is in communication with the uphole drill string;

a downhole connection member operable to connect to a downhole drill string so that the Trojan central bore is in communication with the downhole drill string; and a window assembly moveable between a closed position and an open position, where in the open position the window assembly provides a flow path between the annular storage space and an outside of the outer tubular member, and where in the closed position the window assembly prevents a flow between the annular storage space and the outside of the outer tubular member; where the window assembly has a window area that is more than 25% of a total surface area of an outer surface of the outer tubular member.

2. The assembly of claim 1, where the annular storage space is free of communication with the Trojan central bore.

3. The assembly of claim 1, further including a material located within the annular storage space, where the material includes a solid material.

4. The assembly of claim 3, where the solid material has a maximum length dimension of 30 feet.

5. The assembly of claim 1, where the window assembly has a window area that is 50% of a total surface area of an outer surface of the outer tubular member.

6. The assembly of claim 1, where the window assembly includes a plurality of separate window elements and where a cumulative window area which is a sum of an area of the plurality of separate window elements, is more than 25% of a total surface area of an outer surface of the outer tubular member.

7. A drill pipe assembly for drilling a subterranean well, the assembly having:

an uphole drill string positioned within a wellbore of the subterranean well and having an uphole central bore;

a downhole drill string positioned within the wellbore of the subterranean well having a downhole central bore;

a Trojan drill pipe positioned within the wellbore of the subterranean well between the uphole drill string and the downhole drill string and having:

an inner tubular member having a Trojan central bore centered around a central axis of the inner tubular member;

an outer tubular member, the outer tubular member circumscribing the inner tubular member and being coaxially aligned with the inner tubular member;

an annular storage space defined by an inner diameter surface of the outer tubular member and an outer diameter surface of the inner tubular member; and a window assembly moveable between a closed position and an open position, where in the open position the window assembly provides a flow path between the annular storage space and an annulus defined between an outer diameter surface of the outer tubular member and an inner diameter surface of the wellbore, and where in the closed position the window assembly prevents a flow between the annular storage space and the annulus; and a material located within the annular storage space, where the material includes a solid material; where the uphole drill string is connected to an uphole end of the Trojan drill pipe so that the uphole central bore is in communication with the Trojan central bore;

the downhole drill string is connected to a downhole end of the Trojan drill pipe so that the downhole central bore is in communication with the Trojan central bore; and the uphole central bore has an uphole bore diameter, the Trojan central bore as a Trojan bore diameter, and the downhole central bore has a downhole bore diameter, and the uphole bore diameter, the Trojan bore diameter, and the downhole bore diameter are substantially equal.

8. The assembly of claim 7, where the annular storage space is free of communication with the Trojan central bore.

9. The assembly of claim 7, where the solid material has a maximum length dimension of 30 feet.

10. The assembly of claim 7, where the window assembly has a window area that is more than 25% of a total surface area of an outer surface of the outer tubular member.

11. The assembly of claim 7, where the window assembly includes a plurality of separate window elements and where a cumulative window area which is a sum of an area of the plurality of separate window elements, is more than 25% of a total surface area of an outer surface of the outer tubular member.

12. A method for drilling a subterranean well with a drill pipe assembly, the method including:

positioning a downhole drill string within a wellbore of the subterranean well, the downhole drill string having a downhole central bore;

connecting the downhole drill string to a downhole end of a Trojan drill pipe and positioning the Trojan drill pipe within the wellbore of the subterranean well;

connecting an uphole end of the Trojan drill pipe to an uphole drill string having an uphole central bore, and positioning the uphole drill string within the wellbore of the subterranean well so that the Trojan drill pipe is positioned within the wellbore of the subterranean well between the uphole drill string and the downhole drill string, where the Trojan drill pipe has:

an inner tubular member having a Trojan central bore centered around a central axis of the inner tubular member, the Trojan central bore being in communication with the downhole central bore and the uphole central bore;

an outer tubular member, the outer tubular member circumscribing the inner tubular member and being coaxially aligned with the inner tubular member;

an annular storage space defined by an inner diameter surface of the outer tubular member and an outer diameter surface of the inner tubular member; and a window assembly moveable between a closed position and an open position; where the uphole central bore has an uphole bore diameter, the Trojan central bore as a Trojan bore diameter, and the downhole central bore has a downhole bore diameter, and the uphole bore diameter, the Trojan bore diameter, and the downhole bore diameter are substantially equal; and moving the window assembly from the closed position to the open position to deliver a material located within the annular storage space into an annulus defined between an outer diameter surface of the outer tubular member and an inner diameter surface of the wellbore, where in the closed position the window assembly prevents a flow between the annular storage space and the annulus, and where in the open position the window assembly provides a flow path between the annular storage space and the annulus; where the window assembly has a window area that is more than 25% of a total surface area of an outer surface of the outer tubular member.

13. The method of claim 12, where the annular storage space is free of communication with the Trojan central bore.

14. The method of claim 12, where the material includes a solid material and the method further includes delivering the solid material into the annulus.

15. The method of claim 14, where the solid material has a maximum length dimension of 30 feet.

16. The method of claim 12, where the window assembly includes a plurality of separate window elements and where a cumulative window area which is a sum of an area of the plurality of separate window elements, is more than 25% of a total surface area of an outer surface of the outer tubular member.

17. The method of claim 12, where the window assembly has a window area that is 50% of a total surface area of an outer surface of the outer tubular member.

* * * * *